US006203131B1

(12) United States Patent
Wiklof

(10) Patent No.: US 6,203,131 B1
(45) Date of Patent: Mar. 20, 2001

(54) DUAL TECHNOLOGY PRINTER

(75) Inventor: Christopher A. Wiklof, Everett, WA (US)

(73) Assignee: Intermec IP Corp., Beverly Hills, CA (US)

( * ) Notice: Subject to any disclaimer, the term of this patent is extended or adjusted under 35 U.S.C. 154(b) by 0 days.

(21) Appl. No.: 09/123,629

(22) Filed: Jul. 28, 1998

(51) Int. Cl.[7] ..... B41J 3/00
(52) U.S. Cl. ..... 347/2; 347/218
(58) Field of Search ..... 347/2, 215, 218, 347/219, 221, 262, 264; 219/121.67; 101/248, 254; 226/2, 28, 35

(56) References Cited

U.S. PATENT DOCUMENTS 4,264,957 * 4/1981 Pautzke ..... 101/248
5,611,949 * 3/1997 Snellman et al. ..... 219/121.67

* cited by examiner

*Primary Examiner*—N. Le
*Assistant Examiner*—Hai C. Pham
(74) *Attorney, Agent, or Firm*—Joan H. Pauly

(57) ABSTRACT

A dual technology printer includes first and second print stations having a polychromatic print engine and a monochromatic print engine, respectively. The print engines are preferably an ink jet print engine and a thermal print engine. A variable length media queue is formed between the two print stations. The queue may be formed by a guide roller that defines a loop of media between the stations and that is movable to adjust the length of the loop and thereby the length of the queue. Preferably, the second print station has a predetermined pixel addressability and a resolution substantially equal to the addressability to produce sharp borders for machine readable symbologies. In a printing operation, the printing of color images at the first print station may be carried out ahead of demand for a particular batch printing operation during which monochromatic images are printed at the second print station.

24 Claims, 2 Drawing Sheets

DUAL TECHNOLOGY PRINTER

TECHNICAL FIELD

This invention relates to a printer having a first polychromatic print station, a second monochromatic print station, and a pathway between the stations for guiding a continuous strip of media from the first station to the second station and providing a variable length queue between the stations. This arrangement allows printing of a high quality color image and a sharply defined monochromatic image on the same media location while minimizing delays in the printing process.

BACKGROUND INFORMATION

In the printing of bar code labels, it is sometimes desirable or required to have a color image on the label as well as the typically black bar code image. The previous approach to providing printers having the capability of printing such labels has been to utilize a single printing technology in the printer. Since the various known printing technologies have widely differing characteristics in regard to the print quality produced, the use of a single technology to produce both color images and bar code images has required compromises that result in severe limitations on the print quality of the color image and/or the bar code image.

For bar codes and other machine readable symbologies, it is desirable that the printed image have sharp boundaries that are accurately detectable by a machine. Sharp boundaries are produced by pixels (printed dots) that have essentially the same dimensions-as the addressability of the print engine. In order words, the printed dots remain discrete and do not overlap or bleed into each other. The main technologies that meet this criterion are direct thermal and thermal transfer. For color images, color saturation is a major consideration for producing a high quality image. Pixels that are large relative to the addressability of the printer cause undesirable bleeding of bar code borders across narrow spaces in the symbol, significantly hurting readability. On the other hand, relatively large pixels provide the desired color saturation for color images. Technologies that produce relatively large pixels include ink jet, electrophotography, and dot matrix impact.

The different desirable characteristics of bar code and color images and the different technologies that produce these desirable characteristics have led to the compromises referred to above. The standard industry practice has been to use the sharp definition technologies of direct thermal and thermal transfer for the printing of bar codes, whether or not each printed label also includes a color image. Currently existing color bar code printers have generally used thermal transfer technology. The use of this technology has caused either high printer cost or low throughput, i.e. slow printing rates, as well as relatively high media expense. In order to maintain a relatively high throughput, color thermal transfer printers must essentially replicate the entire printing mechanism for each color desired. Therefore, the equipment cost for a color bar code printer that prints black as well as a normal range of colors is nearly four times that of a monochrome printer. One approach to achieving lower printer costs has been to sequentially array on a ribbon all of the colors to be used in the images to be produced by a printer. In such an arrangement, the media must be fed backward and then forward for each color after the first color. The backward and forward feeding causes slow throughput as well as registration inaccuracies. In both the arrangement of multiple print mechanisms and the arrangement of a sequentially arrayed ribbon, a print head lifting mechanism may be required to allow independent feeding of ribbon and paper. Print head lifting mechanisms contribute significantly to reliability problems, noise, and cost.

The failure of the industry to provide an acceptable color bar code printer is a result of a general failure to fully appreciate the nature of the problem and the actual needs of most situations in which bar code labels with color images are to be printed. This lack of understanding has led to the unsuccessful efforts described above. Such efforts have resulted in printer designs that are either excessively expensive or that fail to meet practical needs.

SUMMARY OF THE INVENTION

The present invention provides a printer and a method of printing that avoid or minimize the problems that have been encountered in relation to previous color bar code printers. A major contribution of the invention is a full appreciation of the nature of the problems associated with printing bar code/color image labels and an accurate assessment of the practical requirements for such printing. These requirements are discussed more fully below.

According to an aspect of the invention, a dual technology printer comprises a first print station, a second print station, and pathway means. The first print station has a polychromatic print engine. The second print station has a monochromatic print engine. The pathway means extends between the stations for guiding a continuous strip of media from the first station to the second station and providing a queue between the stations including a variable length of media.

The pathway means may provide the media queue in various ways. In a first embodiment, the pathway means provides a variable length loop of media between the stations. In another embodiment, the pathway means provides an accordion fold arrangement of media between the stations. The strip of media may be fully continuous or may include a number of discrete media segments. For example, the media segments may be discrete adhesive backed labels carried on a continuous liner strip. The specific type of print engines may also be varied. Currently, a polychromatic ink jet print engine and a monochromatic thermal print engine are preferred. As used herein the term "thermal print engine" includes both direct thermal print engines and thermal transfer print engines.

According to another aspect of the invention, a dual technology printer includes first and second print stations and at least one guide roller. The first and second print stations have a polychromatic print engine and a monochromatic print engine, respectively. The guide roller is positioned between and offset from the stations to provide a looped pathway for a media strip between the stations. The roller thereby provides a length of media queued between the stations. The roller is movably mounted to permit the length of media queued between the stations to be varied by adjusting the position of the roller.

The printer may include a single guide roller or a plurality of guide rollers. In the latter case, the guide rollers may be arranged to provide a plurality of loops along the pathway. The single guide roller or one or more of a plurality of guide rollers are preferably movably mounted to permit the queued length of media to be varied.

According to still another aspect of the invention, a dual technology printer comprises a first print station having a polychromatic print engine and a second print station having a monochromatic print engine. The monochromatic print engine has a predetermined pixel addressability and a resolution substantially equal to the addressability to produce sharp borders for machine readable symbologies. A variable length pathway extends from the first print station to the second print station. The pathway provides a queue between the stations including a variable length of a strip of media.

The pathway may include a variable length loop. In such case, preferably, at least one guide roller is positioned between and offset from the stations to define a bight portion of the loop. As a supplement or alternative to the loop, the pathway may include a support for the media in an accordion fold arrangement.

The invention also encompasses a method of printing a polychromatic image and a monochromatic machine readable symbology at a plurality of locations on a strip of media. According to an aspect of the invention, the method comprises providing a first print station having a polychromatic print engine, and a second print station having a monochromatic print engine with a predetermined pixel addressability and a resolution substantially equal to the addressability. At the first print station, the polychromatic print engine is operated to print a polychromatic image at a plurality of locations on a strip of media. A queue of the media, including said locations, is formed between the print stations. Media is moved from the queue into the second print station. At the second print station, the monochromatic print engine is operated to print a machine readable symbology on each said location moved into the second print station.

The method may be used for printing a single batch of labels or other images. It may also be used for sequentially printing a plurality of batches. In such case, the method preferably comprises forming a queue of a first batch of media locations. While the media locations in the first batch are moving into the second print station, the printing of a second batch of media locations is begun at the first print station.

It is anticipated that, for different applications, it will be desirable to have different lengths of media in the queue. One way of adjusting the queue length is to adjust a straight-line distance between the stations. This would most often be done during the manufacture or installation of the printer or, at a minimum, prior to the commencement of the printing operation. Queue length may also be adjusted by forming the queue by forming a loop of media between the stations, and adjusting the length of the loop. Such adjustment may be made as an adjustment of the maximum loop length prior to the printing operation or by varying the loop length during the printing operation.

The method and apparatus of the invention provide efficient and reliable printing of color bar code labels. The image quality is maximized for both the color image portion and the symbology portion of the labels. Thus, the bar code quality and reliability of reading of the bar code are maximized without sacrificing a desirable high quality and attractive color image. The use of the invention helps to minimize media and printer costs. It also avoids throughput reductions, i.e. allows for relatively quick and efficient printing of labels without the undesirable slowing of the printing process that has been encountered in the past.

As noted above, part of the contribution of the invention is an appreciation of the true practical requirements for a color bar code printer. Most bar code printing applications do not require high sustained throughput, but do require high burst throughput. The latter refers to a high throughput in a batch printing operation in which a defined number of labels or other items are printed with a clear beginning and end of the printing procedure and, typically, a cessation of printing once the batch is completed. The media queue feature of the invention provides the capability of producing a maximized burst throughput. On bar code labels, most color images are small relative to the overall image area. In addition, most color images are predictable and repeating, with the black bar code being the portion of the image that changes. Because of these factors, the color image portion of labels may be preprinted prior to the time that a batch printing operation has been fully defined. A queue of media segments is formed between the two print stations. Then, when the system in which the printer is operating requires the batch printing, the bar code portions of the labels are printed at the second print station. This procedure allows the demand for the labels to be satisfied in the shortest amount of time possible limited only by the speed of the second print station.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

The drawings show printing apparatus that incorporates the best modes for carrying out the apparatus of the invention currently known to the applicant. The drawings also illustrate the best modes for carrying out the method of the invention currently known to the applicant.

Figure 1:
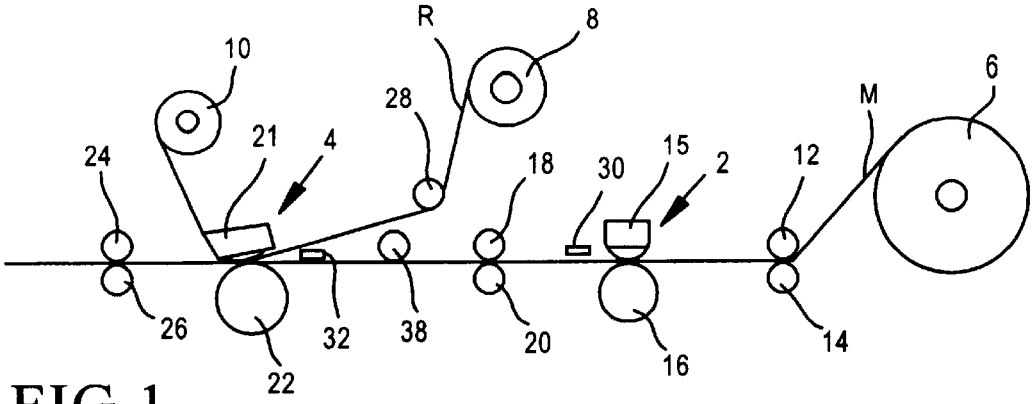
FIG. 1 is a partially schematic elevational view of a printer incorporating a first embodiment of the invention having a guide roller positioned to provide a minimal length queue between print stations.
Figure 2:
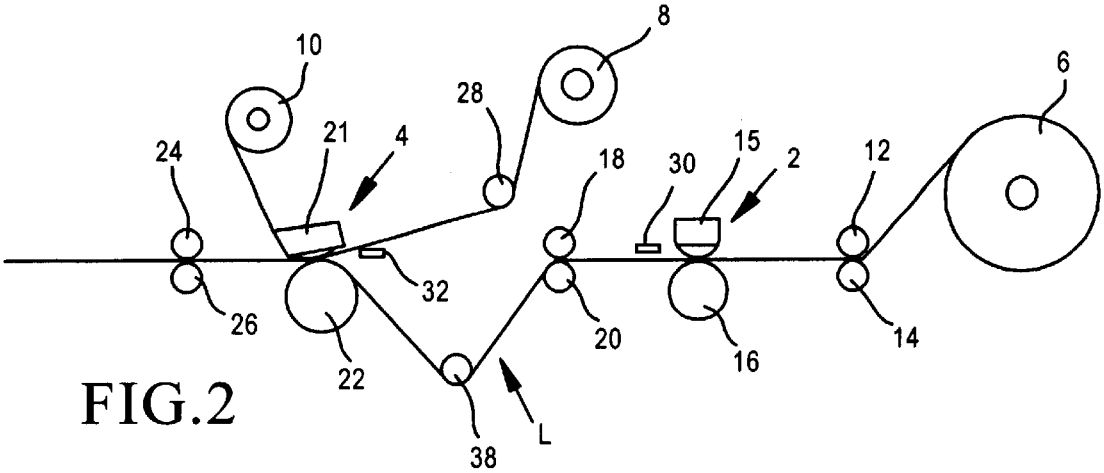
FIG. 2 is like FIG. 1 except that it shows the guide roller moved to increase the length of the queue.

FIGS. 1 and 2 are schematic representations of the working portions of a printer incorporating a first embodiment of the invention. The mechanism shown in FIGS. 1 and 2 includes conventional printer elements as well as novel elements that are a part of the present invention. The novel elements include the presence of two print stations, a first upstream print station 2 and a second downstream print station 4. The conventional elements include a supply roll 6 from which a continuous strip of media M is supplied to the print stations 2, 4. They also include a supply roll 8 from which a thermal transfer ribbon R is drawn for use at the second print station 4. The ribbon R moves from the supply roll 8 around a guide roller 28 and through the print station 4 to a take-up roll 10. Media M from the supply roll 6 travels between a pair of guide rollers 12, 14 of a known type to the print station 2. The print station 2 has a print engine 15 of a known type that cooperates with a platen roller 16 also of a known type. The media M extends through and from the print station 2 to another pair of guide rollers 18, 20, which may be of the same type as the rollers 12, 14. From the guide rollers 18, 20, the media is M extends to the second print station 4, which has a second print engine 21 cooperating with a platen roller 22, both of a known type. A third pair of guide rollers 24, 26 is positioned downstream of the second print station 4.

Preferably, first and second sensors 30, 32 are positioned immediately adjacent to and downstream of the first print station 2 and immediately upstream of the second print station 4, respectively. The sensors 30, 32 are of a known type and may be, for example, label gap sensors that measure label gap positions and label lengths in a known manner. This type of sensor is used with media that includes discrete labels carried on a continuous strip of liner material. The preferred positioning of the sensors 30, 32 illustrated and described herein facilitates the practice of the best mode of the method of the invention.

The apparatus of the invention comprises a dual technology printer having components such as those illustrated in FIGS. 1, 2, 5, and 6. The print engine 15 in the first print station 2 is a polychromatic print engine for printing color images. In the currently preferred embodiments, the print engine 15 is an ink jet print engine. The print engine 21 at the second print station 4 is a monochromatic print engine. In the currently preferred embodiments, the print engine 21 is preferably a thermal print engine. As illustrated, the print engine 21 is a thermal transfer print engine that thermally transfers an image onto the media M from the ribbon R. It is anticipated that, in the typical use of the invention, the image will be black image of a symbology, such as a bar code.

The dual technology printer of the invention also includes pathway means between the stations 2, 4 for guiding the continuous strip of media M from the first station 2 to the second station 4 and providing a queue between the stations 2, 4 including a variable length of media M. As shown in FIGS. 1 and 2, the printer includes a guide roller 38 positioned between and offset from the stations 2, 4. The roller 38 is movably mounted to permit the length of media M queued between the stations 2, 4 to be varied by adjustment of the position of the roller 38. As used herein, the phrase "offset from the stations 2, 4" and the like refer to a position of the guide roller 38, such as that shown in FIG. 2, in which the roller 38 has been moved downwardly (as shown) to define a bight portion of a loop L and provide a looped pathway for the media M between the stations 2, 4. The looped pathway provides a length of media M queued between the stations 2, 4. The movability of the guide roller 38 makes the length of the loop L variable to vary the length of the queue and the portion of the media strip M in the queue. In situations in which the media M includes discrete media segments, such as discrete labels, the variable length of media M in the queue includes a variable number of media segments. FIG. 1 illustrates a neutral position of the guide roller 38 in which the roller 38 is above the straight-line distance between the two print stations 2, 4 to provide a minimum length straight-line pathway for the media M between the stations 2, 4.

Figure 3A:
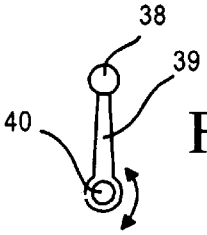
FIG. 3A is a schematic elevational view of a first mechanism for moving the guide roller to vary the length of the queue.

The movable mounting of the guide roller 38 may be accomplished in various ways. FIG. 3A illustrates a first type of mounting arrangement. In this arrangement, a single guide roller 38 is mounted on one end of an arm 39. The other end of the arm 39 engages a pivot shaft 40. The shaft 40 is pivoted in a known manner to pivot the arm 39 and the guide roller 38 attached thereto between the neutral position shown in FIG. 1 and the looped position shown in FIG. 2 or between either of these positions and further offset positions increasing or decreasing the length of the loop L shown in FIG. 2.

Figure 4:
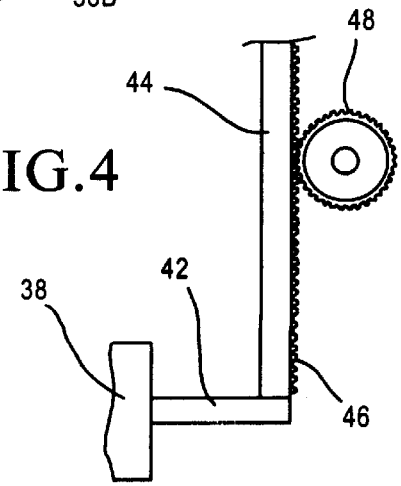
FIG. 4 is a partially schematic elevational view taken at a right angle to FIG. 2 and illustrating another type of mechanism for adjusting the position of the guide roller.

The mounting mechanism illustrated in FIG. 3A is currently preferred because it is most cost effective. Another possible mounting mechanism is illustrated in FIG. 4. Referring to FIG. 4, the end of guide roller 38 opposite the end visible in FIGS. 1 and 2 has a support shaft 42 extending axially therefrom. A mounting bar 44 extends perpendicularly and upwardly from the support shaft 42. The rack 46 of a rack and pinion mechanism 46, 48 is carried by the bar 44. The pinion 48 is powered in a known manner to engage the rack 46 and move the guide roller 38 vertically upwardly and downwardly. The advantage of this type of arrangement is that it provides vertical only movement. The disadvantage is that it can be cumbersome and is relatively expensive.

Figure 5:
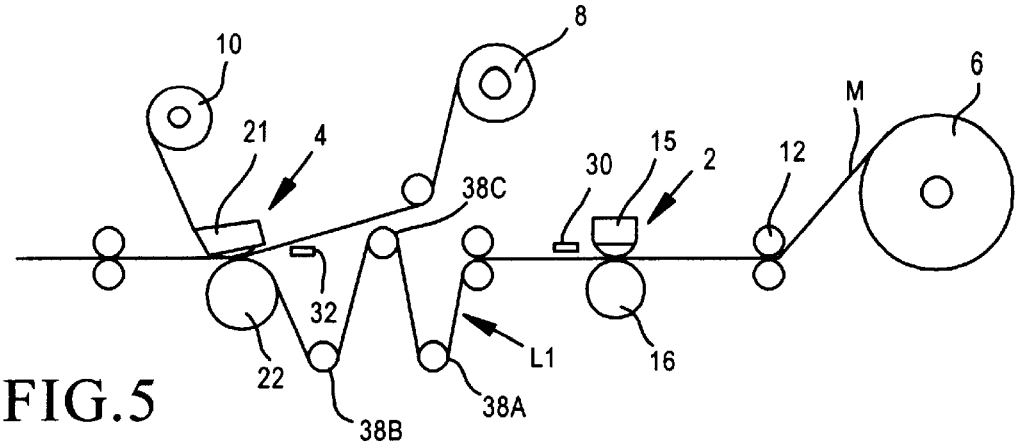
FIG. 5 is similar to FIG. 2 except that it shows another embodiment of the invention which includes two guide rollers.

FIG. 5 illustrates another embodiment of the apparatus of the invention that is similar to the embodiment shown in FIGS. 1 and 2. The most significant difference is that the embodiment shown in FIG. 5 has three guide rollers 38A, 38B, 38C, rather than the single guide roller 38 shown in FIGS. 1 and 2. In accordance with the invention, dual technology printers that provide variable length queues by means of one or more guide rollers may have a single guide roller, as shown in FIGS. 1 and 2, two guide rollers, three guide rollers, as shown in FIG. 5, or a greater number of guide rollers. A plurality of guide rollers provides a plurality of loops along the pathway between the two print stations 2, 4. FIG. 5 illustrates two loops L1, L2. Preferably, each of a plurality of the guide rollers is movably mounted to permit the length of media M queued between these stations 2, 4 to be varied. In the embodiment of FIG. 5, preferably the rollers 38A and 38B are movably mounted, and the third roller 38C has a fixed position to help define the loops L1, L2.

Figure 3B:
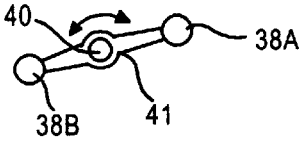
FIG. 3B is a schematic elevational view of a second mechanism for moving two guide rollers.
Figure 3C:
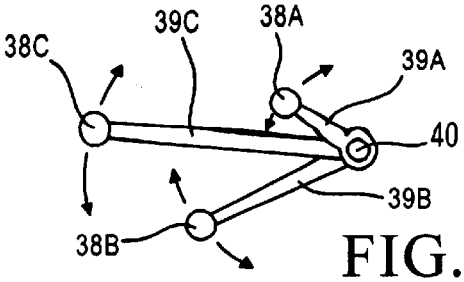
FIG. 3C is a schematic elevational view of a third mechanism for moving three guide rollers.

FIGS. 3B and 3C illustrate mounting arrangements for movably mounting a plurality of guide rollers. FIG. 3B shows a pivotal mount for two guide rollers 38A, 38B. In this arrangement, a single pivot shaft 40 carries a pivot arm 41. The arm 41 has opposite portions extending in diametrically opposite directions from the shaft 40. The two guide rollers 38A, 38B are mounted on the outer ends of these arm portions, respectively. The arrangement could be used for mounting the two guide rollers in a printer having two guide rollers or for mounting two of a greater number of guide rollers, such as the three guide rollers shown in FIG. 5. The arrangement has the advantage of simplicity but the disadvantage of not permitting independent movement of the two guide rollers 38A, 38B. In a two guide roller printer, this apparent drawback can be minimized by allowing one of the guide rollers to move above the straight-line path and the other guide roller to move below the path to minimize the amount of pivot of the arm 41 required to provide a particular desired loop length in the queue.

FIG. 3C illustrates another pivotal mount arrangement for a plurality of guide rollers. In this arrangement, any number of pivot arms are mounted on a single pivot shaft 40. FIG. 3C shows three pivot arms 39A, 39B, 39C. Each of the arms 39A, 39B, 39C is independently pivotable to independently pivot the guide roller 38A, 38B, 38C mounted on the outer end of the arm 39A, 39B, 39C. The advantages of this arrangement include maximum flexibility in the positioning of the guide rollers 38A, 38B, 38C and versatility since the arrangement can accommodate any number of pivot arms and guide rollers. Preferably, the lengths of the guide rollers 38A, 38B, 38C at the ends that are engaged by the pivot arms 39A, 39B, 39C are varied to avoid interference with the pivoting of one of the pivot arms by other pivot arms.

Figure 6:
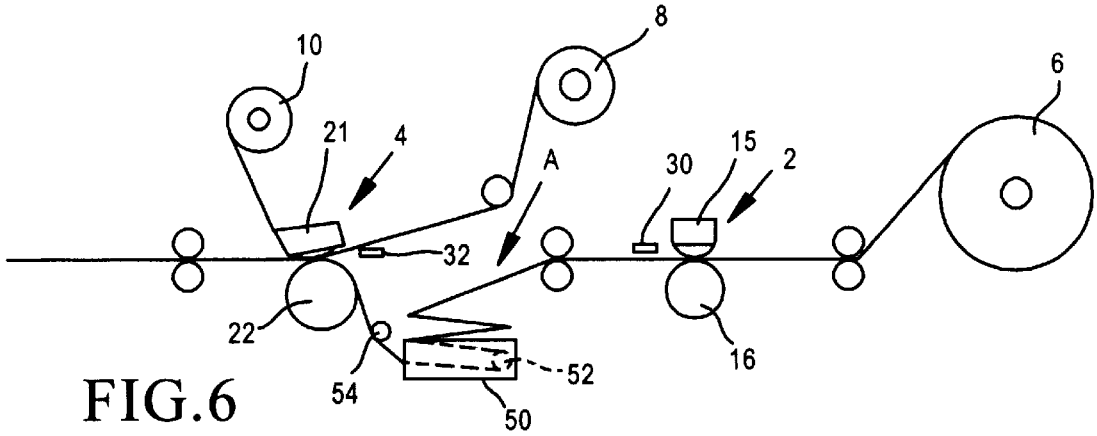
FIG. 6 is similar to FIGS. 2 and 5 but shows still another embodiment of the invention.

Currently, the variability of the length of the queue is preferably provided by a guide roller arrangement, such as those discussed above. However, other arrangements for achieving a variable length queue may also be used in accordance with the invention. One such arrangement is illustrated in FIG. 6. In this embodiment, an accordion fold arrangement A of media M is formed between the stations 2, 4 to form the variable length queue. Referring to FIG. 6, a support 50 supports the folded media M in the accordion arrangement. The support 50 may take a box-like form and include a small guide roller 52 at its upstream end. The lowermost media fold extends around roller 52 and out through the downstream end of the support 50 to an additional small guide roller 54 and then to the second print station 4. The accordian-fold arrangement may be provided in combination with movable guide rollers or separately, as shown in FIG. 6.

As described above, the primary purpose of the invention is to provide efficient and reliable printing of color bar code labels having a high quality color image and also a high quality bar code image. In order to accomplish the latter, the boundary lines of the bar code image need to be sharp to be accurately readable by a machine. In accordance with the invention, the second print station 4 preferably has a monochromatic print engine with a predetermined pixel addressability and a resolution substantially equal to the addressability to produce the desired sharp borders for machine readable symbologies.

Figure 7:
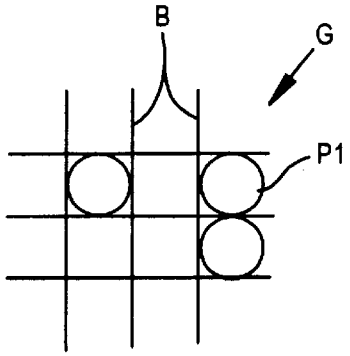
FIG. 7 is a graphic representation of printed pixels produced by a print engine in which the resolution is substantially equal to the addressability.
Figure 8:
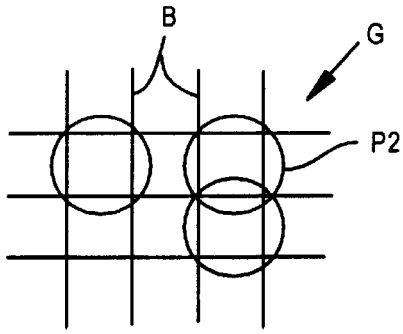
FIG. 8 is similar to FIG. 7 but illustrates the image created by a print engine in which the pixels, and hence the resolution, is large relative to the addressability.

FIGS. 7 and 8 illustrate this feature. FIG. 7 shows in graphic form a greatly enlarged portion of a high resolution print image. For the sake of illustration, the pixels P1 or dots that form the image are shown on a grid G. Each square in the grid G represents an address recognized by the print engine. Since the resolution of the engine is substantially equal to its addressability, each pixel P1 fits into its assigned address square and does not bleed over the boundary lines B of the address. This results in a sharp, well-defined image. In contrast, FIG. 8 illustrates the image produced by a print engine in which the resolution is less sharp and the pixels P2 have dimensions larger than the addressability of the print engine. As shown in FIG. 8, the pixels P2 bleed over the boundary lines B in the grid G and reduce the sharpness of the image. For a color image, this bleeding of the printed dots helps to increase color saturation for a more vivid image. However, for a monochromatic image that requires sharp boundaries for machine readability, it is highly undesirable since it obscures the boundaries and thereby can decrease the accuracy of the machine reading.

In addition to the printing apparatus, the invention also provides a method of printing a polychromatic image and a monochromatic machine readable symbology at a plurality of locations on a strip of media. The method comprises providing a first print station and a second print station, such as the print stations 2, 4 shown in the drawings and described above. The first print station 2 has a polychromatic print engine 15, and the second print station has a monochromatic print engine 21. The monochromatic print engine 21 preferably has a predetermined pixel addressability and a resolution substantially equal to the addressability, as illustrated in FIG. 7 and described above. The method further comprises operating the polychromatic print engine 15 at the first print station 2 to print a polychromatic, or color, image at a plurality of locations on a strip of media M. A queue of media M, including these locations, is formed between the print stations 2, 4. Then, the media M is moved from the queue into the second print station 4. At the second print station 4, the monochromatic print engine 21 is operated to print a machine readable symbology on each location moved into the second print station 4. The locations on the media may be defined by discrete label blanks carried on a continuous liner web to form the strip of media M. Alternatively, the portion of the media on which the images are printed may be continuous with or without a liner. In such case, cutting of the media into discrete labels or other media segments would typically be accomplished following the two printing operations. The cutting may be performed in any of a variety of known ways.

It is anticipated that the printing operation at the first print station 2 and the filling of the queue with media on which color images have been printed will be part of an initialization procedure. This may be done prior to the commencement of the printing operation at the second print station 4 to help maximize the burst print speed of the final printing operation by allowing the slower polychromatic print station 2 to be operated to print the color images in advance of the demand for the labels or other media images. The initialization also comprises, prior to any printing, registering the labels relative to each print station 2, 4, determining the queue length or number of labels between stations 2, 4, and determining the format to be printed. During the initialization, the media M is loaded with a straight-line path between the print stations 2, 4, as illustrated in FIG. 1. This minimizes label wastage during initialization. There is a known (but wide tolerance) web length between the print stations 2, 4. The second downstream print station 4 indexes labels forward, i.e. in a downstream direction. The label gap sensor 32 immediately upstream from the second station 4 measures label gap positions and label length in a well-known manner. The platen roller 16 at the polychromatic station 2 is allowed to freely rotate. The label gap sensor 30 adjacent to the first station 2 monitors gap and label movement immediately adjacent to the station 2. When the label and gap length for the two sensors 30, 32 agree, the system recognizes the web between stations 2, 4 as being taut. Next, the number of labels between the stations 2, 4 is determined. The web length between stations 2, 4 is divided by the measured repeat length (gap plus label) for the media M.

The guide rollers 38, 38A, 38B, 38C or other means for providing a variable length queue are adjusted to provide a predetermined number of labels in the queue. The adjustment of the roller positions 38, 38A, 38B, 38C may be carried out prior to printing at the first print station 2 or, to minimize label wastage, as the first print station 2 is printing the color images to fill the queue. As the queue is filled, the second print station indexes the labels forward until the first color printed location or label is in a ready position in the second station 4. The ready position is one in which the label or media location is ready to be printed by the monochromatic print engine 21. At the completion of initialization, one additional label or location is printed at the polychromatic station 2 to avoid interference with a selected print speed at the second station 4.

In the practice of the method of the invention, a single batch of media locations or labels may be printed and then operation of the printer discontinued until another batch is demanded. Alternatively, the requirements of a particular situation may call for or permit the printing of a second batch of locations immediately after the completion of the printing of a first batch. Thus, the method may comprise forming a queue of a first batch of media locations and, while moving media locations in the first batch into the second print station 4, beginning to print a second batch of media locations at the first print station 2.

As noted above, the invention allows the initialization procedure to be carried out in advance of the demand for labels. The second portion of the method may be termed batch printing and may occur in a time frame separated from the initialization procedure. The batch printing procedure includes the printing operation at the second print station 4 of a demanded number of labels that may be as few as one but typically is greater than one. As the printing at the second station 4 is carried out, the quantity of labels or media locations in the queue is continuously monitored as is the remaining quantity of locations in the batch. When a second batch is to be printed immediately following the first batch, the next batch. format is determined as the first batch printing operation is carried out and printing at the first print station 2 is controlled to optimize the throughput of the printer and minimize media wastage. The constant monitoring helps ensure that only the appropriate number of color printed labels are produced for each batch. The simultaneous but essentially asynchronous operation of the two print stations 2, 4 achieves maximum efficiency and the desired high burst speed discussed above. If no second batch has been defined but it is known that the color image will not change, controlled printing at the first print station 2 may be similarly continued during a batch printing procedure. If no second batch has been defined and the color image may vary, the first print station 2 is set idle when it has completed printing color images for the first batch and thereafter passively feeds media as required by the second station 4 to print all labels in the first batch.

The carrying out of the method of the invention in the most efficient way possible requires that the queue length between the two print stations 2, 4 be varied in accordance with the demands of a particular printing situation. One way of adjusting the length of the queue is to adjust the straight-line distance between the stations 2, 4. Ordinarily, this method of adjusting the queue length would be carried out as part of the manufacture of the printer prior to the delivery of the printer to the ultimate user. Once the printer has been delivered to a user, the queue length may be adjusted by adjusting the length of one or more loops, as described above.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A dual technology printer comprising:

a first print station having a polychromatic print engine;

a second print station having a monochromatic print engine; and pathway means between said stations for guiding a continuous strip of media from said first station to said second station and providing a queue between said stations including a variable length of media;

said print engines being operable asynchronously to allow said length of media to be queued prior to operation of said monochromatic print engine to print images on said length of media, to enable maximized throughput at said second print station.

2. The printer of claim 1, wherein said pathway means provides a variable length loop of media between said stations.

3. The printer of claim 1, wherein said pathway means provides an accordion fold arrangement of media between said stations.

4. The printer of claim 1, wherein said polychromatic print engine is an ink jet print engine, and said monochromatic print engine is a thermal print engine.

5. The printer of claim 1, wherein the variable length of media includes a variable number of media segments.

6. The printer of claim 5, wherein said pathway means provides a variable length loop of media segments between said stations.

7. A dual technology printer comprising:

a first print station having a polychromatic print engine;

a second print station having a monochromatic print engine; and at least one guide roller having a position between and offset from said stations to provide a looped pathway for a media strip between said stations and thereby provide a length of media queued between said stations, said roller being movably mounted to permit the length of media queued between said stations to be varied by adjustment of said position of said roller;

said print engines being operable asynchronously to allow said length of media to be queued prior to operation of said monochromatic print engine to print images on said length of media, to enable maximized throughput at said second print station.

8. The printer of claim 7, wherein said polychromatic print engine is an ink jet print engine, and said monochromatic print engine is a thermal print engine.

9. The printer of claim 7, which comprises a plurality of guide rollers arranged to provide a plurality of loops along said pathway.

10. The printer of claim 9, wherein each of a plurality of said guide rollers is movably mounted to permit the length of media queued between said stations to be varied.

11. A dual technology printer comprising:

a first print station having a polychromatic print engine;

a second print station having a monochromatic print engine with a predetermined pixel addressability and a resolution substantially equal to said addressability to produce sharp borders for machine readable symbologies; and a variable length pathway from said first print station to said second print station providing a queue between said stations including a variable length of a strip of media;

said print engines being operable asynchronously to allow the length of media to be queued prior to operation of said monochromatic print engine to print images on the length of media, to enable maximized throughput at said second print station.

12. The printer of claim 11, wherein said polychromatic print engine is an ink jet print engine, and said monochromatic print engine is a thermal print engine.

13. The printer of claim 11, wherein said pathway includes a variable length loop.

14. The printer of claim 13, which comprises at least one guide roller positioned between and offset from said stations to define a bight portion of said loop.

15. The printer of claim 11, which comprises a plurality of guide rollers arranged to provide a plurality of loops along said pathway.

16. The printer of claim 15, wherein each of a plurality of said guide rollers is movably mounted to permit the length of media in said queue to be varied.

17. The printer of claim 11, wherein said pathway includes a support for said media in an accordion fold arrangement.

18. A method of printing a polychromatic image and a monochromatic machine readable symbology at a plurality of locations on a strip of media, comprising:

providing a first print station having a polychromatic print engine, and a second print station having a monochromatic print engine with a predetermined pixel addressability and a resolution substantially equal to said addressability;

at said first print station, operating said polychromatic print engine at a first print speed to print a polychromatic image at a plurality of locations on a strip of media;

forming a queue of said media, including said locations, between said print stations;

after forming said queue, moving media from said queue into said second print station, and, at said second print station, operating said monochromatic print engine at a second print speed, faster than said first print speed, to print a machine readable symbology on each said location moved into said second print station.

19. The method of claim 18, which comprises forming a queue of a first batch of media locations; and, while moving media locations in said first batch into said second print station, beginning to print a second batch of media locations at said first print station.

20. The method of claim 18, in which providing said print stations includes adjusting a straight-line distance between said stations to adjust the length of said queue.

21. The method of claim 18, in which forming said queue comprises forming a loop of media between said stations.

22. The method of claim 21, comprising adjusting the length of said queue by adjusting the length of said loop.

23. The method of claim 18, in which forming said queue comprises forming a plurality of loops of media between said stations.

24. The method of claim 23, comprising adjusting the length of said queue by adjusting the length of at least one of said loops.

* * * * *